US009121553B2

(12) United States Patent
Yao

(10) Patent No.: US 9,121,553 B2
(45) Date of Patent: Sep. 1, 2015

(54) LED LAMP STRUCTURE

(71) Applicant: Chao-Chin Yao, Taichung (TW)

(72) Inventor: Chao-Chin Yao, Taichung (TW)

( * ) Notice: Subject to any disclaimer, the term of this patent is extended or adjusted under 35 U.S.C. 154(b) by 111 days.

(21) Appl. No.: 14/132,254

(22) Filed: Dec. 18, 2013

(65) Prior Publication Data

US 2015/0167903 A1 Jun. 18, 2015

(51) Int. Cl.
*F21K 99/00* (2010.01)
*F21Y 101/00* (2006.01)

(52) U.S. Cl.
CPC ..... *F21K 9/30* (2013.01); *F21Y 2101/00* (2013.01)

(58) Field of Classification Search
CPC ..... F21Y 2101/00
USPC ..... 362/382
See application file for complete search history.

(56) References Cited

U.S. PATENT DOCUMENTS

2014/0254174 A1* 9/2014 Yamamoto ..... 362/311.14

* cited by examiner

*Primary Examiner* — David V Bruce
(74) *Attorney, Agent, or Firm* — Rosenberg, Klein & Lee

(57) ABSTRACT

A light emitting diode (LED) lamp structure fixed to a mount and capable of emitting light for illumination includes a substrate, a light emitting element, a lamp cup and a joint member, and the light emitting element is installed on the substrate and has an LED lamp, and the lamp cup is mounted on the substrate and covered onto the light emitting element, and both joint member and mount have a joint portion, and one of the joint portions is concave and the other one is convex, and the concave joint portion has a diameter difference to define a large end and small end, and the convex portion is plugged from the large end of the concave joint portion, rotated with the joint member to move to the small end, and then fixed to the mount of the joint member.

5 Claims, 7 Drawing Sheets

LED LAMP STRUCTURE

FIELD OF THE INVENTION

The present invention relates to a light emitting diode (LED), in particular to an LED lamp structure that can be installed or removed conveniently.

BACKGROUND OF THE INVENTION

With reference to FIG. 7 for a conventional LED lamp structure, the conventional LED lamp structure comprises a bottom plate 91, a light emitting element 92 and a lamp cup 93. The conventional LED lamp structure is installed at a plate member 94 of a ceiling, and it is necessary to remove the lamp cup 93 from the bottom plate 91 before the installation and then pass the bottom plate 91 through the plate member 94 by using a bolt 911 and secure the bottom plate 91 by a nut 912, and finally the lamp cup 93 is installed back to the bottom plate 91, so as to achieve the illumination effect by the light emission of a LED lamp 921 of the light emitting element 92.

However, if a user wants to change the whole set of the LED lamp structure, the user has to remove the lamp cup 93 from the bottom plate 91 first and then loosen the nut 912 on the plate member 94 to separate the bolt 911 from the plate member 94 and disconnect a power circuit (not shown in the figure) of the light emitting element 92. Now, the user can remove the bottom plate 91 from the plate member 94. Although it is not difficult for users to install and remove the aforementioned LED lamp structure, the installation and removal processes require the removal of the lamp cup 93 and the reinstallation of the bolt 911, and thus causing inconvenience of the use. Obviously, the conventional LED lamp structure requires further improvements.

SUMMARY OF THE INVENTION

Therefore, it is a primary objective of the present invention to overcome the aforementioned problems by providing an LED lamp structure to achieve the effect of convenient installation and removal.

To achieve the foregoing objective, the present invention provides an LED lamp structure that is fixed to a mount and capable of emitting light for illumination, and the mount includes a first joint portion, characterized in that the LED lamp structure comprises:

a substrate, having a first surface and a second surface, and the first surface and the second surface being disposed on two opposite sides of the substrate respectively;

a light emitting element, installed on the first surface of the substrate, and having at least one LED lamp capable of emitting light towards the first surface;

a lamp cup, mounted onto the first surface of the substrate, and covered onto the light emitting element;

a joint member, having a second joint portion and the first joint portion, and one of the first and second joint portions being concave, and the other one of the first and second joint portions being convex, and the concave joint portion having a diameter difference to define a large end and a small end, and the convex portion being plugged from the large end of the concave joint portion, rotated with the joint member to move to the small end, and then fixed to the mount of the joint member.

DESCRIPTION OF THE PREFERRED EMBODIMENTS

The aforementioned and other objectives and advantages of the present invention will become clearer in light of the following detailed description of an illustrative embodiment of this invention described in connection with the drawings. It is intended that the embodiments and drawings disclosed herein are to be considered illustrative rather than restrictive.

Figure 1:
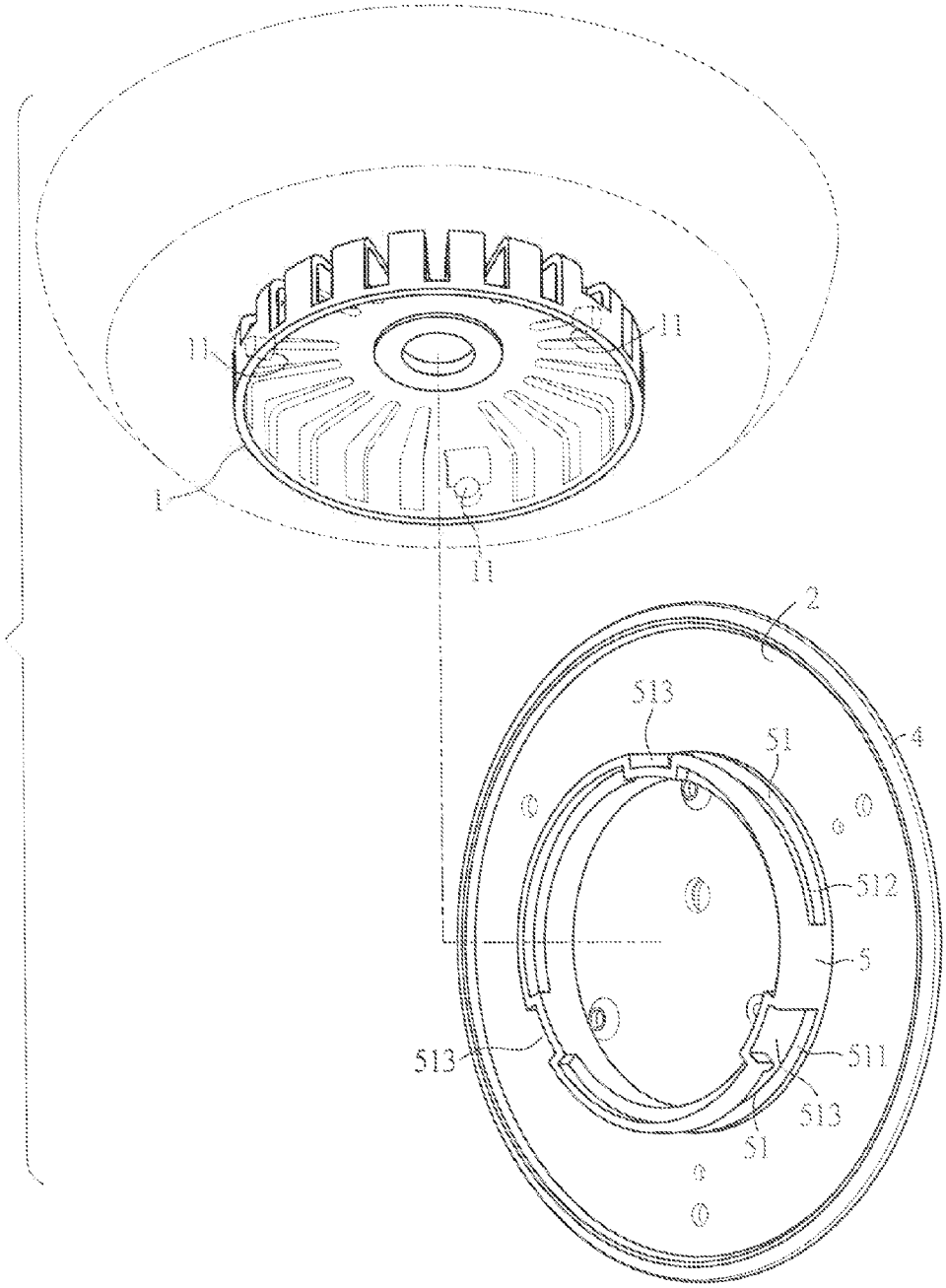
FIG. 1 is a perspective view of installing an LED lamp structure and a mount of a first preferred embodiment of the present invention.
Figure 2:
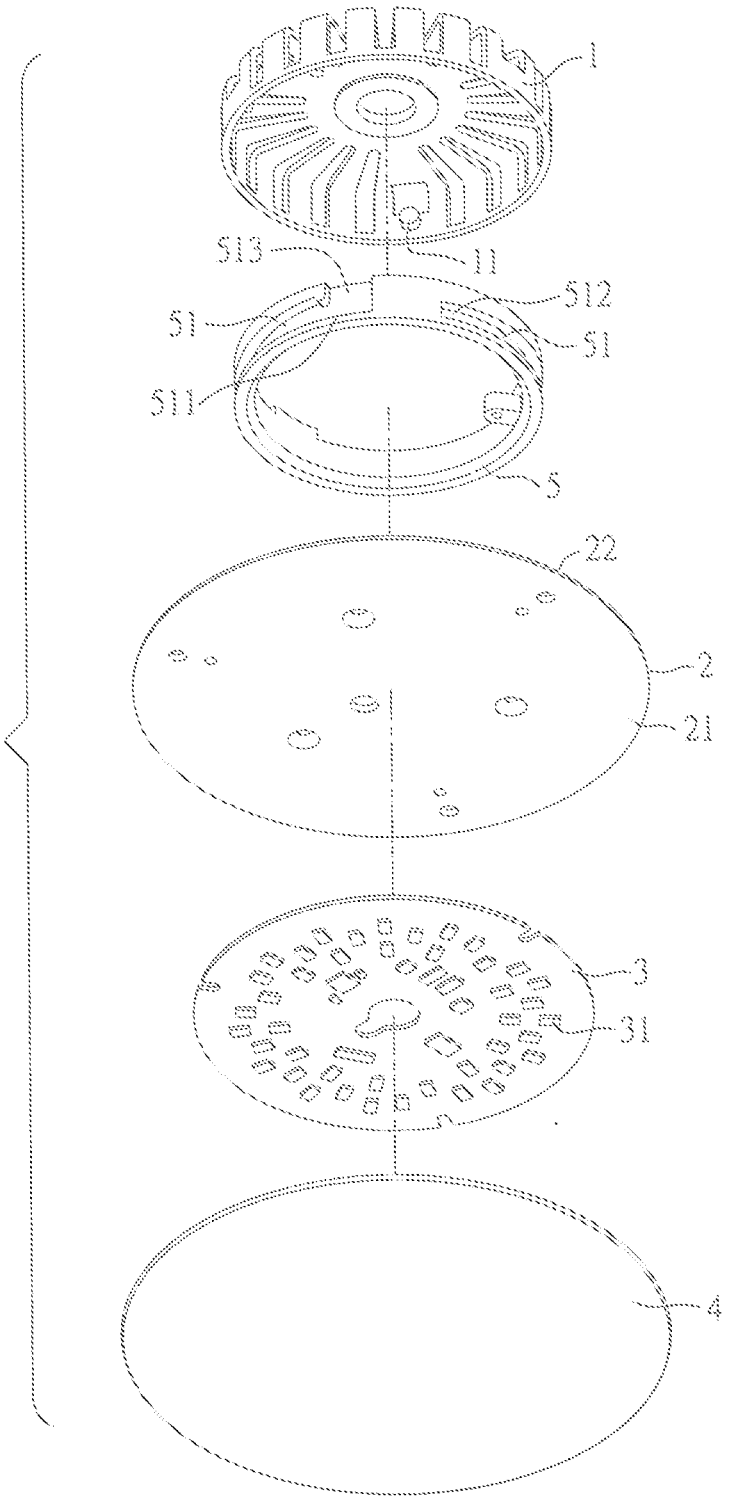
FIG. 2 is an exploded view of an LED lamp structure of the first preferred embodiment of the present invention.

With reference to FIGS. 1 and 2 for an LED lamp structure of the first preferred embodiment of the present invention, the LED lamp structure is fixed to a mount 1 and capable of emitting light for illumination, and the mount 1 includes a first joint portion, and the LED lamp structure comprises a substrate a light emitting element 3, a lamp cup 4 and a joint member 5.

Figure 3:
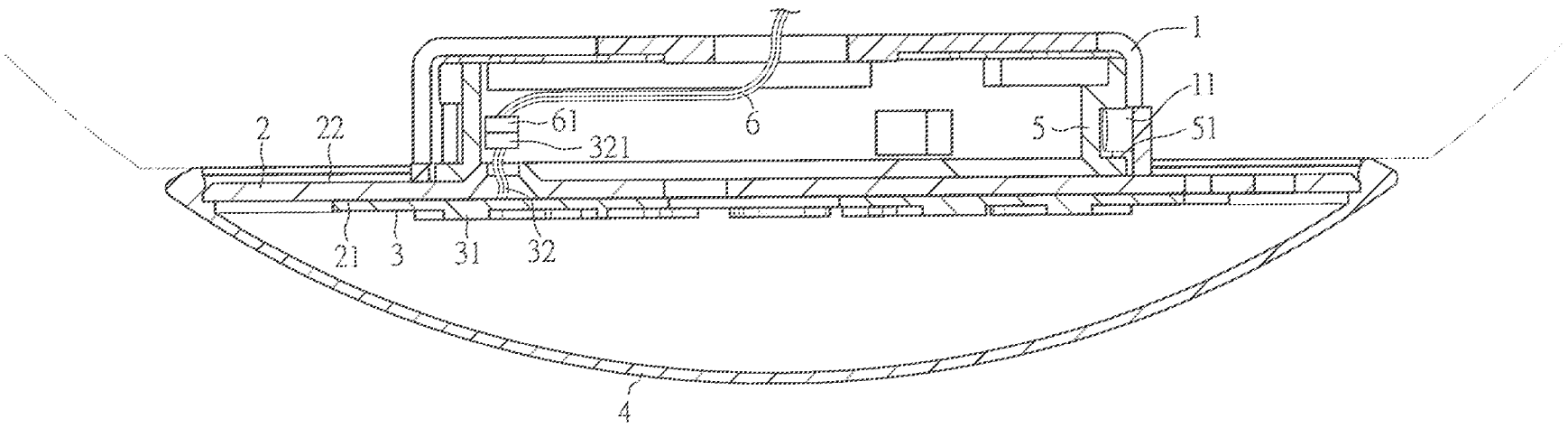
FIG. 3 is a sectional view of an LED lamp structure of the first preferred embodiment of the present invention.

In FIGS. 2 and 3, the substrate 2 includes a first surface 21 and a second surface 22, and the first surface 21 and the second surface 22 are disposed on both opposite sides of the substrate 2 respectively, and the light emitting element 3 is installed on the first surface 21 of the substrate 2, and the light emitting element 3 includes a plurality of LED lamps 31 capable of emitting lights in a direction towards the first surface 21, and the lamp cup 4 is fixed onto first surface 21 of the substrate 2 for covering the light emitting element 3.

In FIG. 3, the light emitting element 3 of this preferred embodiment includes a first power line 32 passing out from the joint member 5, and an end of the first power line 32 has a first connector 321, a second power line 6 connected to an external power supply is extended into the mount 1, and an end of the second power line 6 has a second connector 61, and the second connector 61 and the first connector 321 are coupled to each other to electrically connect the first power line 32 with the second power line 6.

The joint member 5 includes a second joint portion and the first joint portion, wherein one of the joint portions is convex and the other one is concave, and the concave joint portion has different diameters to define a large end and a small end, wherein one of the first and second joint portions is concave, and the other one of the first and second joint portions is convex, and the concave joint portion has a diameter difference to define a large end and a small end, and the convex portion is plugged from the large end of the concave joint portion, rotated with the joint member 5 to move to the small end, and then fixed to the mount 1 of the joint member 5.

With reference to FIGS. 2 and 3 for the first preferred embodiment of the present invention, the first joint portion is a bump, and the second joint portion is a slanting slot 51, and an end of the slanting slot 51 with a greater slot width is the large end 511, and the other end of the slant slot 51 with a smaller slot width is the small end 512. in addition, the width of the slanting slot 51 is tapered from the large end 511 to the small end 512, and the slanting slot 51 has an entrance 513 formed at the large end 511 and opened from a lateral side of the joint member 5.

Figure 4:
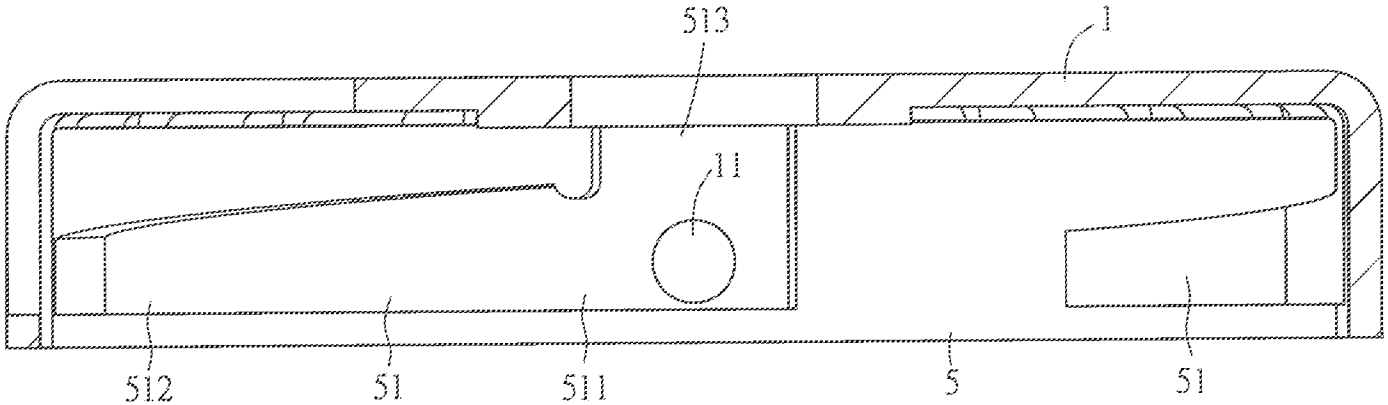
FIG. 4 is a schematic view of as joint member that is passed through an entrance, aligned precisely with a bump, and installed into a mount in accordance with the first preferred embodiment of the present invention.
Figure 5:
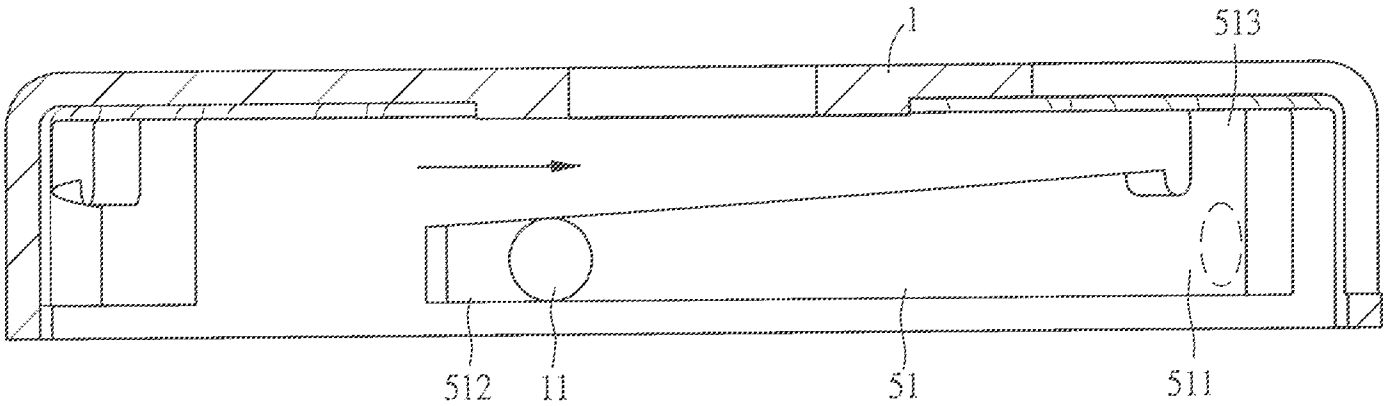
FIG. 5 is a schematic view of a joint member that is rotated to put a bump into a small end of a slanting slot in accordance with the first preferred embodiment of the present invention.

In this preferred embodiment, when the LED lamp structure is installed to the mount 1, a first connector 321 of a first power line 32 of the light emitting element 3 is coupled to a second connector 61 of the second power line 6 to electrically connect the first power line 32 to the second power line 6, and then the joint member 5 is installed to the mount 1 by aligning the entrance 513 of the joint member 5 to the bump 11 of the mount 1 precisely, and plug the tint member 5 into the mount 1 as shown in FIG. 4, and the bump 11 is moved from the entrance 513 into the large end 511 as shown in FIG. 5, and then the joint member 5 is rotated. to move the bump 11 along a track of the slanting slot 51 towards the small end 512, and abut the bump 11 against the small end 512. Now, the joint member 5 has been fixed to the mount 1 to complete installing the LED lamp structure to the mount 1.

If a user wants to separate the LED lamp structure from the mount 1, the user simply rotates the joint member 5 in an opposite direction to move out the bump 11 in a direction towards the large end 511 and release the bump 11 from abutting the small end 512, until the bump 11 is aligned precisely with the entrance 513 in order to remove the joint member 5 form the mount 1 and complete the removal of the LED lamp structure.

In summation of the description above, the present invention has the following advantages. One of the first joint portion of the mount 1 and the second joint portion of the joint member 5 is concave, and the other one is convex, and a rotation of the joint member 5 in the mount 1 produces fixing relation between the convex and concave joint portions, and a rotation of the joint member 5 in an opposite direction in the mount 1 releases the fixing relation between the convex and concave joint portions. Compared with the installation and removal of the conventional LED lamp structure, the present invention provides a convenient way of installing/removing the LED lamp structure to/from the mount 1 to achieve the effect of convenient installation and removal.

Figure 6:
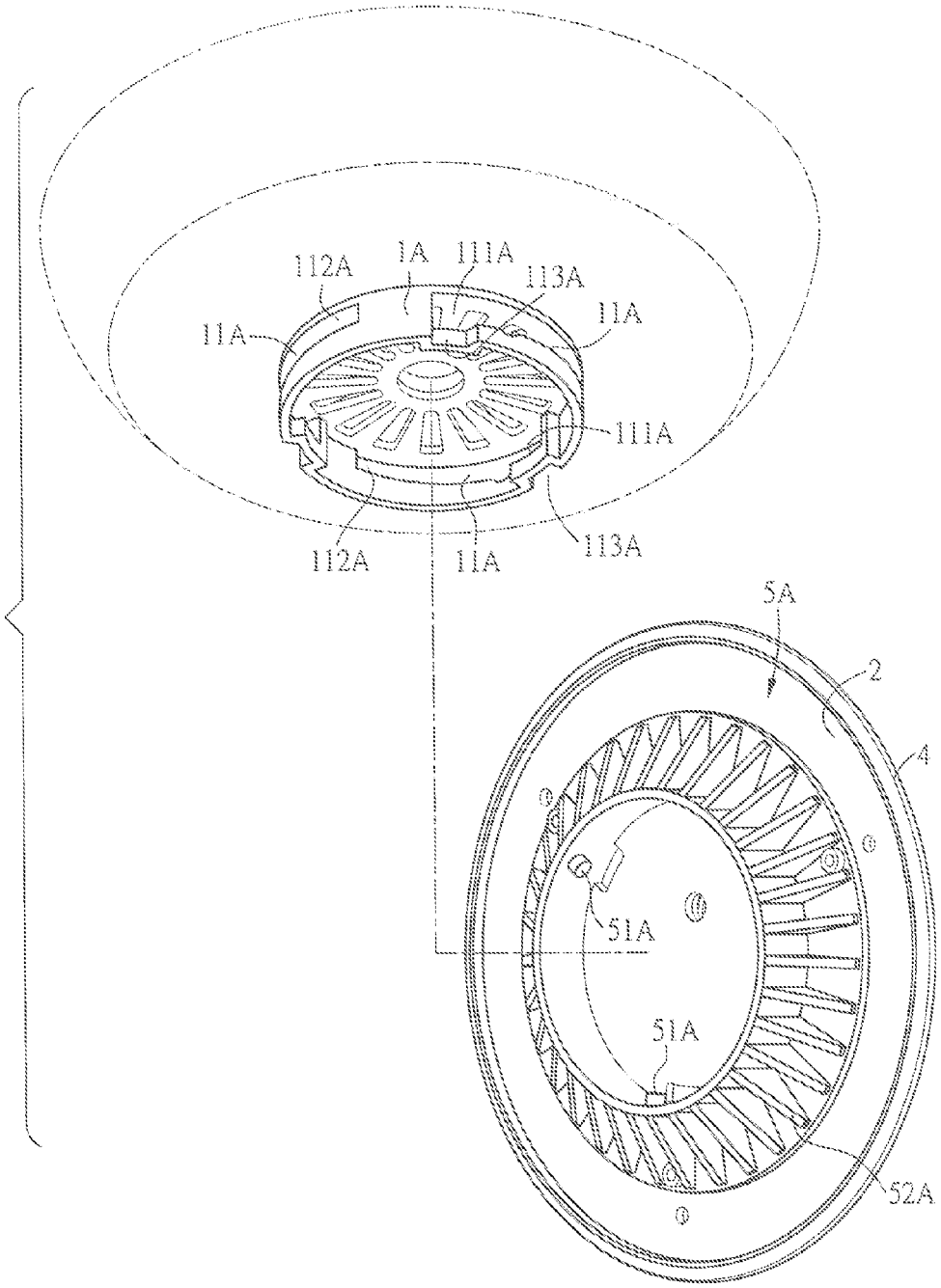
FIG. 6 is a perspective view of installing an LED lamp structure and a mount in accordance with a second preferred embodiment of the present invention.
Figure 7:
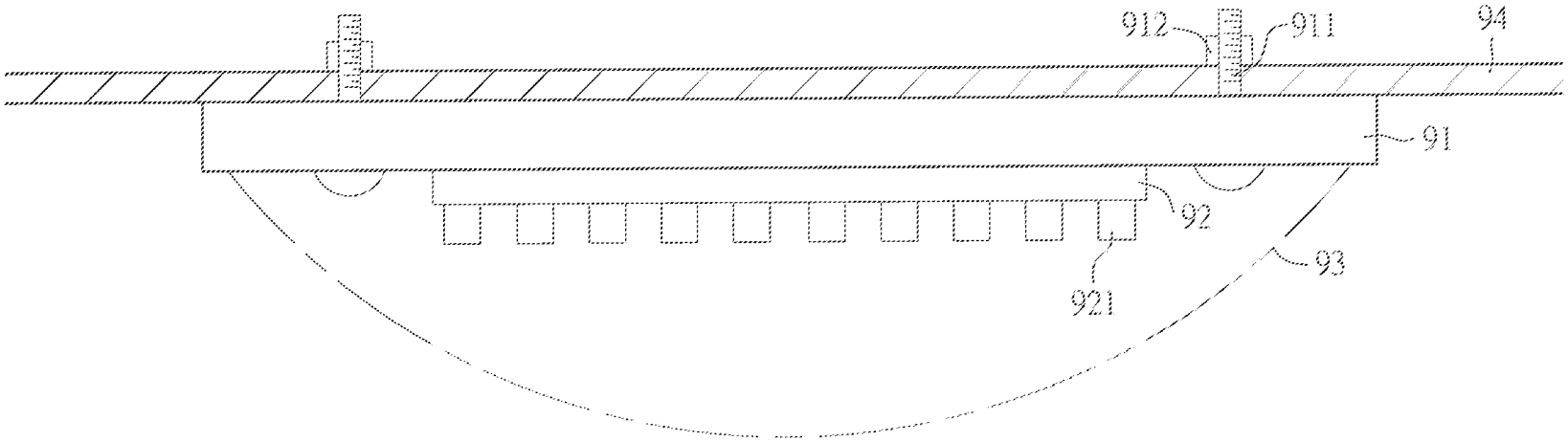
FIG. 7 PRIOR ART
FIG. 7 is a sectional view of a conventional LED lamp structure.

Of course, there are many other examples of the present invention with minor modifications. In FIG. 6, the first joint portion of the mount 1A of this preferred embodiment is a slanting slot 11A, and the second joint portion of the joint member 5A is a bump 51A, and the joint member 5A has a plurality of fins 52A, and the slanting slot 11A has the same structure of the slanting slot 51 of the first preferred embodiment, wherein the slanting slot 11A has a large end 111A, a small end 112A and an entrance 113A, and the bump 51A has the same structure of the bump 11 of the first preferred embodiment. The slanting slot 11A of the mount 1A and the bump of the joint member 5A also can produce the fixing relation of the convex and concave joint portions through the rotation of the joint member 5A in the mount 1A and achieve the same effect of the first preferred embodiment.

The invention claimed is:

1. An LED lamp structure, fixed to a mount and capable of emitting light for illumination, and the mount having a first joint portion, and the LED lamp structure comprising:

a substrate, having a first surface and a second surface, and the first surface and the second surface being disposed on two opposite sides of the substrate respectively;

a light emitting element, installed on the first surface of the substrate, and having at least one LED lamp capable of emitting light towards the first surface;

a lamp cup, mounted onto the first surface of the substrate, and covered onto the light emitting element;

a joint member, having a second joint portion and the first joint portion, and one of the first and second joint portions being concave, and the other one of the first and second joint portions being convex, and the concave joint portion having a diameter difference to define a large end and a small end, and the convex portion being plugged from the large end of the concave joint portion, rotated with the joint member to move to the small end, and then fixed to the mount of the joint member.

2. The LED lamp structure of claim 1, wherein the first joint portion is a bump, and the second joint portion is a slanting slot, and an end of the slanting slot with a greater slot width is the large end, and an end of the slanting slot with a smaller slot width is the small end, and the width of the slanting slot is tapered from the large end towards the small end, and the slanting slot has an entrance formed at the large end and opened from a lateral side of the joint member, and the bump is moved from the entrance into the large end and rotated with the joint member to move along a track of the slanting slot towards the small end, and the bump abuts against the small end.

3. The LED lamp structure of claim 1, wherein the second joint portion is a bump, and the first joint portion is a slanting slot, and an end of the slanting slot with a greater slot width is the large end, and an end of the slanting slot with a smaller slot width is the small end, and the width of the slanting slot is tapered from the large end towards the small end, and the slanting slot has an entrance formed at the large end and opened from a lateral side of the mount, and the bump is moved from the entrance into the large end, and the joint member is rotated along a track of the slanting slot towards the small end, and the bump abuts against the small end.

4. The LED lamp structure of claim 3, wherein the joint member includes a plurality of fins.

5. The LED lamp structure of claim 1, wherein the light emitting element includes a first power line passing out from the joint member, and an end of the first power line has a first connector, and a second power line connected to an external power supply is extended into the mount, and an end of the second power line has a second connector, and the second connector and the first connector are coupled to electrically connect the first power line to the second power line.

* * * * *